United States Patent [19]

Rock et al.

[11] 4,068,349

[45] Jan. 17, 1978

[54] HINGE

[76] Inventors: Erich Rock, Kuferstrasse 1085, A-6973 Hochst; Bernhard Mages, Harte 10, A-6850 Dornbirn, both of Austria

[21] Appl. No.: 673,892

[22] Filed: Apr. 5, 1976

[30] Foreign Application Priority Data

| | | |
|---|---|---|
| Apr. 7, 1975 | Austria | 2623/75 |
| Mar. 4, 1976 | Austria | 1582/76 |

[51] Int. Cl.[2] ..... E05D 7/04

[52] U.S. Cl. ..... 16/131; 16/140

[58] Field of Search ..... 16/129–133, 16/163, 164, 165, 166, 173, 183, 140

[56] References Cited

U.S. PATENT DOCUMENTS

| | | | |
|---|---|---|---|
| 3,772,735 | 11/1973 | Lautenschlaeger | 16/129 |
| 3,890,670 | 6/1975 | Sewing et al. | 16/129 |
| 3,938,219 | 2/1976 | Rock et al. | 16/130 |
| 3,952,364 | 4/1976 | Lautenschlaeger | 16/128 R X |
| 3,977,041 | 8/1976 | Rock et al. | 16/129 |

*Primary Examiner*—G. V. Larkin

*Attorney, Agent, or Firm*—Haseltine, Lake & Waters

[57] ABSTRACT

A hinge in which a base plate which is attachable to a piece of furniture cooperates with a hinge arm and an intermediate member between the base plate and the arm. The arm carries toggle joints and can be anchored in the base plate. The intermediate member is in the form of two intermediate elements which have lugs that grip behind projections on the base plate, when in the assembled state. At least one intermediate element is provided with a projection which extends into an opening in the base plate when the hinge is mounted in place. The intermediate elements are held on the hinge arm by means of a screw, and the nose-shaped member is molded on the respective intermediate elements.

16 Claims, 11 Drawing Figures

HINGE

BACKGROUND OF THE INVENTION

The present invention relates to a hinge with an intermediate piece disposed between the base plate and the hinge arm, in particular for doors in furniture, in which the hinge arm, carrying toggle joints or the like can be anchored in the base plate attachable to part of a piece of furniture.

Known hinges of this kind have the advantage that the base plate in question can be secured on the associated part of the piece of furniture. For example the side wall of the piece, before the piece of furniture is assembled and which on assembling the actual hinge arm, which articulates with the door leaf by means of the toggle joints, only has to be pushed further onto the base plate. Therefore, at the stage when one has to work with the entire door leaf, no more time-consuming work requiring particular precision is needed.

In the case of known hinges here, the hinge arm, or an intermediate piece associated with the hinge arm, is inserted in guides on the base plate and then secured by means of a clamping screw which is supported by the base plate.

The object of the present invention is to provide a hinge which makes possible easy rapid anchorage of the hinge arm on the base plate. In addition, the position of the hinge arm is then to be adjustable, in relation to the base plate, to vary the gap and the depth in the piece of furniture. Finally the hinge arm can be detached from the base plate easily and rapidly.

SUMMARY OF THE INVENTION

This is achieved in accordance with the invention by providing two intermediate pieces which exhibit shoulders that engage behind projections on the base plate in the assembled position and in which at least one intermediate piece exhibits a projection or similar protuberance that engages in an aperture in the base plate when the hinge is fitted.

The hinge, in accordance with the invention, is fitted in such a way that the hinge arm with the two intermediate pieces, which are expediently connected to the hinge arm by screws, is pushed into the base plate. The projection provided on at least one intermediate piece, engages in the associated opening in the base plate. Through this the hinge arm is already securely anchored to the base plate.

Connecting the intermediate pieces to the hinge arm with screws is particularly expedient because this also makes adjustment of the hinge arm in relation to the base plate, possible in a simple manner (by adjusting the screws).

In addition, regarding the ease of dismantling of the hinge arm the intermediate pieces can be formed accordingly. Here again the screws supporting the intermediate pieces play a relevant part.

BRIEF DESCRIPTION OF THE DRAWINGS

In the following embodiment, examples of the invention are described in detail with reference to the figures on the attached drawing without it being intended that the invention be restricted thereto.

DESCRIPTION OF THE PREFERRED EMBODIMENTS

Figure 1:
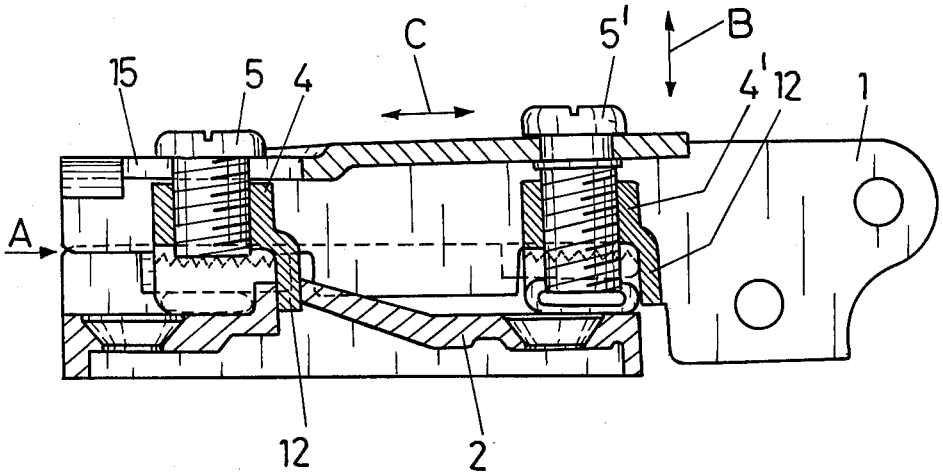
FIG. 1 shows a longitudinal section through a hinge in accordance with the invention.
Figure 1A:
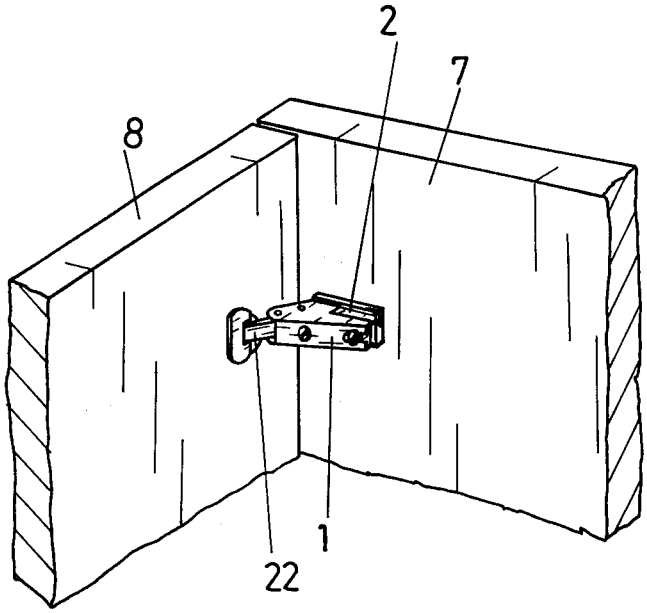
FIG. 1A shows diagrammatically an overall view of a hinge in accordance with the invention.

As can be seen from FIG. 1A, the hinge, in accordance with the present invention, has a hinge arm 1 and a base plate 2. The hinge arm 1 is detachably secured to the base plate 2 with the aid of the two intermediate pieces in accordance with the invention (which are not visible in FIG. 1A). The base plate 2 is secured to the side wall 7 of the piece of furniture, for example, by means of screws 6 (FIG. 3), dowel pins (FIG. 6) or in another suitable manner. A hinge casing 21 is formed in the shape of a cup, for example, and inserted in a hole in the door leaf 8. The hinge arm 1 and the casing are articulated together by means of toggle joints 22. The hinge casing 21 is a part of the hinge that is fixed on the door whereas the hinge arm is fixed on the side wall of the piece of furniture. The hinge casing and the hinge arm are connected by the toggle joints.

Figure 2:
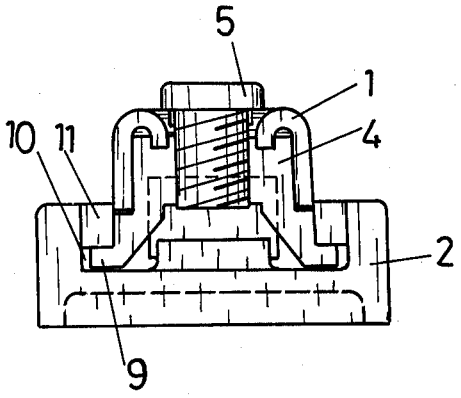
FIG. 2 shows a view of the hinge in accordance with the invention in the direction of arrow A in FIG. 1.

In accordance with the embodiment example in FIGS. 1 and 2 the intermediate pieces 4, 4' consist of female threaded pieces screwed onto screws 5, 5' (supporting screws). These threaded pieces exhibit lugs 9 at their ends facing the base plate. These lugs can be pushed into grooves 10 in the base plate 2 and engage behind the projections 11 on the base plate 2 when in the inserted position (FIG. 2). In this way the inserted hinge arm 1 is prevented from lifting off the base plate 2.

In addition, to prevent the hinge arm 1 from sliding out of the base plate 2 unintentionally, the rear intermediate piece 4 is provided with a projection 12 which engages in an opening 13 in the base plate 2 when assembled. In order to facilitate the engagement or locking of the projection 12, the base plate 2 is provided with a resilient tongue 14 which bounds the opening 13 on one side. When the hinge arm with the intermediate pieces 4, 4' is pushed in, the resilient tongue 14 yields initially and then locks behind the projection 12 of the intermediate piece 4.

For the purposes of standardizing components, the front and the rear intermediate pieces 4, 4' exhibit female threaded pieces of the same form as in FIG. 1. However, in the case of the front intermediate piece 4' the projection 12 is not functionally required (nor functionally troublesome either). The hinge arm is inserted into the base plate (indirectly by means of the intermediate pieces 4, 4').

In the embodiment example in FIGS. 1 and 2 the hinge arm 1 is provided with an open slot 15 at its rear end. The screw 5 of the rear intermediate piece 4 is inserted in this slot 15 and the intermediate piece 4 is held clamped to the hinge arm 1 by the fixing screw 5.

As already mentioned, the hinge arm 1 with the intermediate pieces 4, 4' can be pushed into the guide grooves 10 in the base plate 2. After the projection 12 has been locked in the opening 13, the hinge arm 1 is securely anchored to the base plate 2.

By twisting the front screw 5', which is riveted in the hinge arm 1, the hinge is adjusted to vary the gap in the piece of furniture, i.e. in the direction of the double arrow B.

In order to be able to adjust the hinge for depth in the piece of furniture (double arrow C), the rear screw 5 is slackened slightly and the hinge arm 1 can be adjusted over the length of the slot 15. On completion of the adjustment, the hinge arm 1 is secured again by tightening the screw 5.

Now if the hinge arm 1 is to be detached from the base plate 2, for example when dismantling the piece of furniture, the rear fixing screw 5 is undone and the hinge arm is pulled out whereupon the rear intermediate piece 4 can easily be released by bending down the tongue 14.

Figure 3:
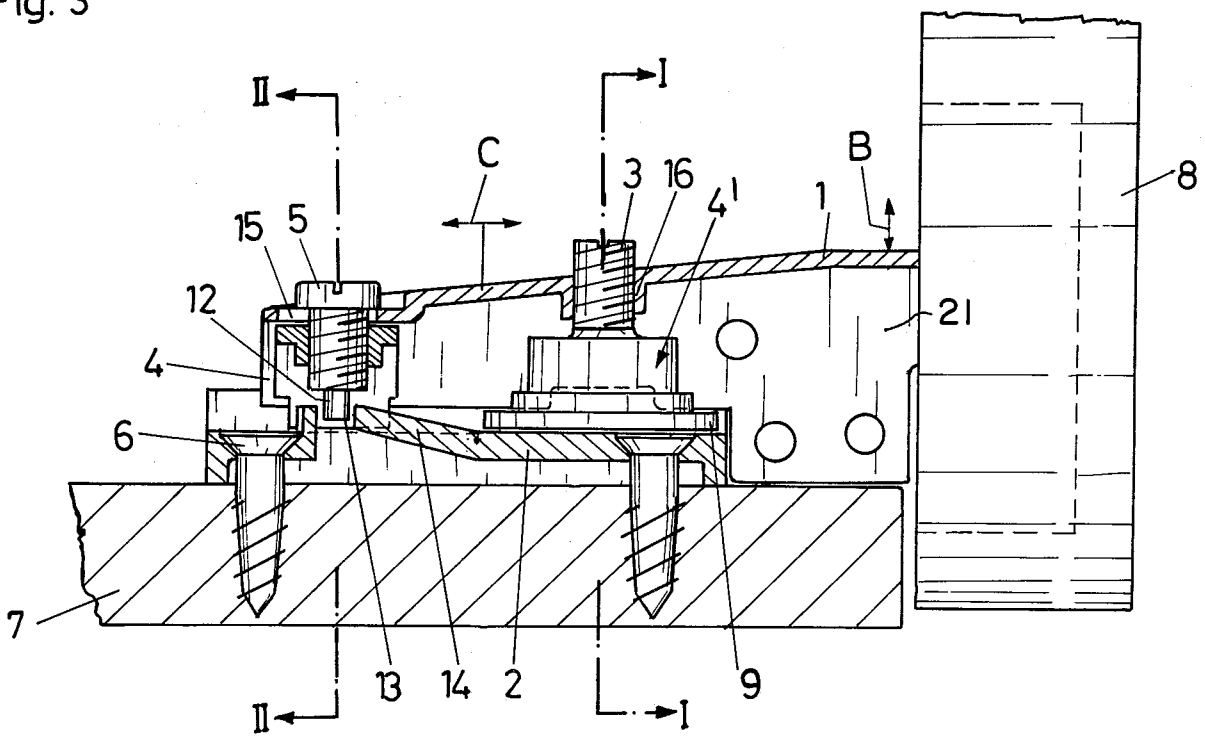
FIG. 3 shows a longitudinal section through a further embodiment example of a hinge in accordance with the invention.
Figure 4:
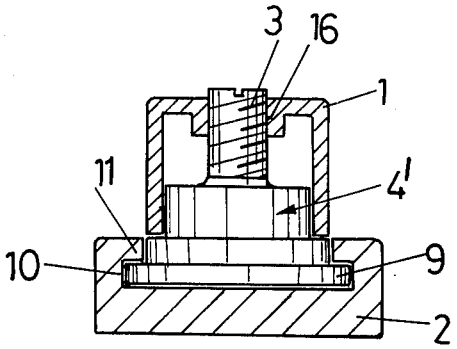
FIG. 4 shows a section taken along the line I—I in FIG. 3.
Figure 5:
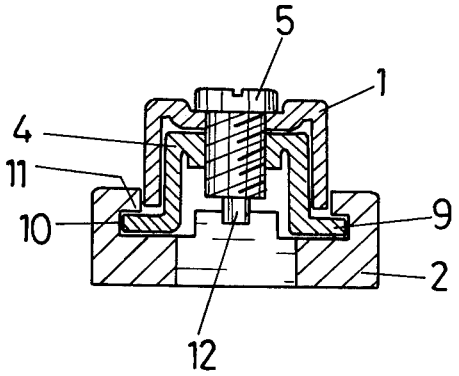
FIG. 5 shows a section taken along the line II—II in FIG. 3.

FIGS. 3 to 5 show an embodiment example in which the front intermediate piece 4' is constituted as a screw (the head of which forms the lug 9 for anchorage behind the projections 11 on the base plate 2) and the threaded shank 3 which sits directly in a thread 16 in the hinge arm 1. In this embodiment example, therefore, adjustment to vary the gap in the piece of furniture (double arrow B) can be effected by turning the intermediate piece 4'.

In the case of the rear intermediate piece 4 in this embodiment example the projection 12 is not formed directly on the intermediate piece 4 but takes the form of a lug on the rear screw 5 supporting this intermediate piece.

The slot 15 which permits adjustment of the hinge in relation to the depth of the piece of furniture (double arrow C), need not necessarily, in accordance with the invention (as in FIG. 1), be made open to the rear as the hinge arm 1 can also be released by undoing the screw 5. This is particularly so in the embodiment example in FIGS. 3 to 5 where in such a case the screw 5 need not be wholly removed from the intermediate piece 4 but just so far that the projection 12 formed on it no longer projects into the opening 13.

Otherwise the function and the fitting of the embodiment example in FIGS. 3 to 5 are the same as for the embodiment example in FIGS. 1 and 2. Even the reference numbers have the same significance.

Figure 6:
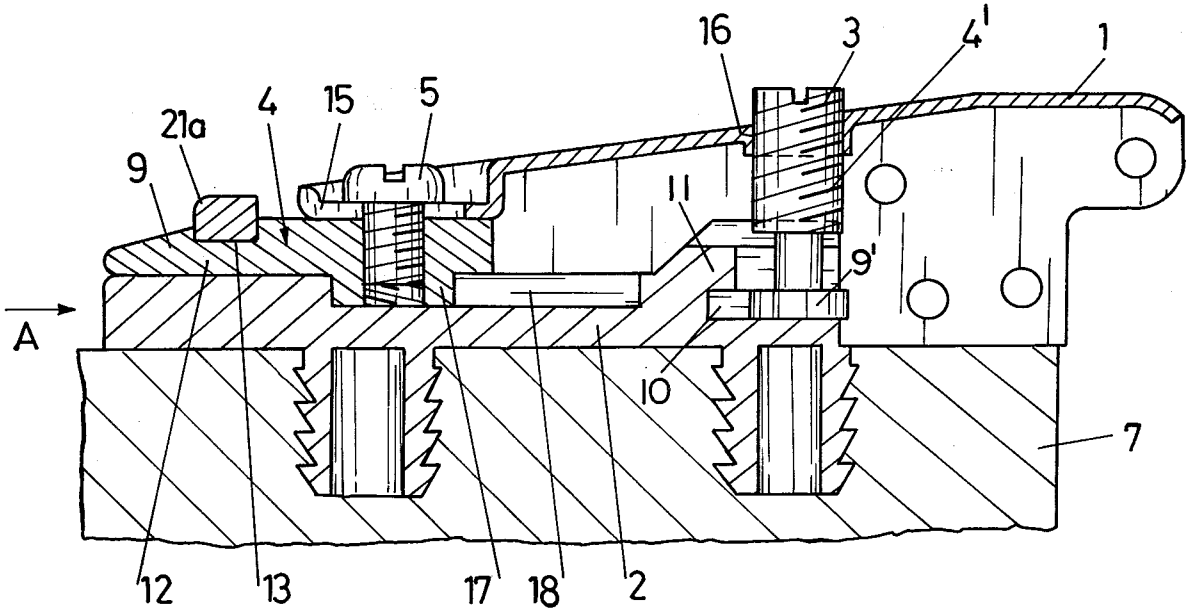
FIG. 6 shows a longitudinal section through a further embodiment example of a hinge in accordance with the invention.
Figure 7:
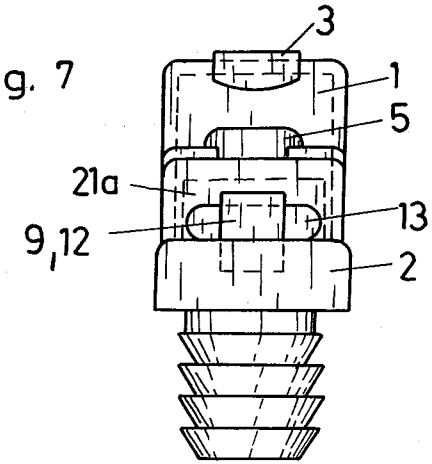
FIG. 7 shows a view from the direction of arrow A in FIG. 6.
Figure 8:
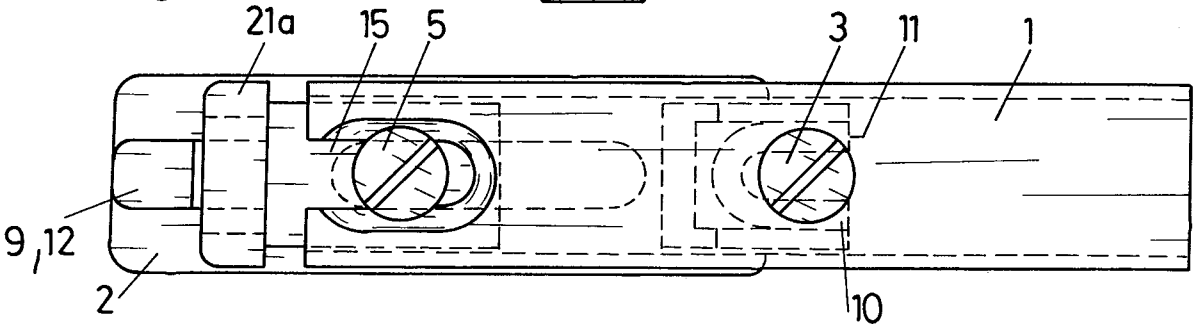
FIG. 8 shows a top view of a hinge in accordance with the invention and FIGS. 9 and 10 show embodiment examples of intermediate pieces in accordance with the invention diagrammatically. de

The embodiment example in FIGS. 6 to 8 differs from the embodiments described up to now primarily in the special formation of the rear intermediate piece 4, while the front intermediate piece 4' is constituted similarly to that in FIG. 3. That is, it consists of a screw, the head of which forms the lug 9 with the intermediate piece 4' engages in grooves 10 under the projections 11 on the base plate 2, and the threaded shank 3 of which sits in a thread 16 in the hinge arm 1.

The rear intermediate piece 4 as in FIGS. 6 to 8 is also held to the hinge arm 1 with the aid of a screw 5, the screw 5 being guided in a slot 15 open to the rear. The intermediate piece 4 exhibits a projection 12 aligned parallel with the assembly face of the base plate 2 projecting towards the rear, this projection engages, when assembled, under a part 21 in form of a bracket disposed on the base plate 2 and bounding an opening 13 in the base plate 2, so to speak. The lug 9 of the intermediate piece 4 is formed on the projection 12, in this case, being supported by the projection formed by the part 21A. To this end the projection 12 is provided with a transverse groove 13 in which the part 21 is locked in the assembled position.

In order to facilitate the engagement of the projection 12, the intermediate piece 4 is made of a yielding plastic material. However, it would also be possible to make the intermediate piece 4 in cast zinc for example if the part 21 on the base plate is made in a resilient material.

For improved guidance of the hinge arm 1 the rear intermediate piece 4 is provided with a projection 17 which extends into a guide groove 18 in the base plate 2.

Figure 9:
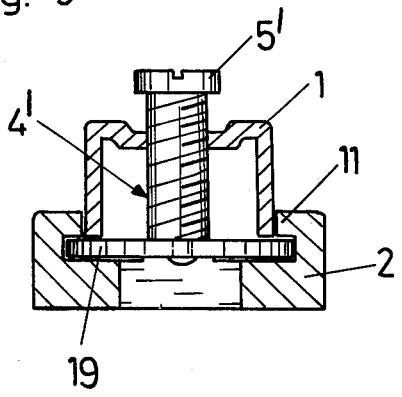
Figure 10:
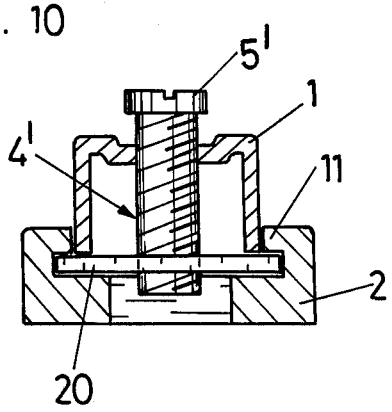

In FIGS. 9 and 10 further examples of embodiments of the front intermediate piece 4' are shown.

First, the intermediate piece 4' is comprised of a disc 19 riveted onto the screw 5'. This disc comes to rest under projections 11 on the base plate 2 in the assembled position (FIG. 9). In the other embodiment example (FIG. 10) the intermediate piece 4' is in the form of a nut 20.

In the last embodiment example the two threads, in which the fixing screw 5 is supported, are opposed. For instance, the thread in the hinge arm 1 is a right-hand thread and the thread in the nut 20 is a left-hand thread. In this way the nut is locked externally by the base plate 2.

We claim:

1. A hinge arrangement comprising, in combination, a base plate; a hinge arm; an intermediate member between said base plate and said hinge arm; toggle joint means carried by said hinge arm, said hinge arm being anchorable in said base plate; projections on said base plate; said intermediate member comprising two intermediate elements having lugs gripping behind said projections; at least one of said intermediate elements having an extended portion extending into an opening of said base plate when the hinge arrangement is mounted in place.

2. The hinge arrangement as defined in claim 1 including screw means for holding said intermediate member on said hinge arm.

3. The hinge arrangement as defined in claim 1 wherein said extended portion comprises screw means; a lug on said screw means, said screw means being threadable in the respective intermediate element carrying said extended portion.

4. The hinge arrangement as defined in claim 1 wherein said extended portion is molded on the respective intermediate element.

5. The hinge arrangement as defined in claim 2 wherein said screw means further connects the respective intermediate element carrying said extended portion with said hinge arm.

6. The hinge arrangement as defined in claim 2 wherein said screw means has clamping means in an open slot in said hinge arm in one of said intermediate elements to the rear relative to a door leaf on which said hinge arrangement is mountable.

7. The hinge arrangement as defined in claim 2 wherein one of said intermediate elements comprises a disc fixed on said screw means.

8. The hinge arrangement as defined in claim 2 wherein one of said intermediate elements comprises a nut having a thread opposite to the thread on said screw means, said screw means having a female thread in said hinge arm.

9. The hinge arrangement as defined in claim 1 wherein said lugs are circular-shaped at the lower edge of at least one intermediate element; a threaded shank on said circular lug, and engaging a thread in said hinge arm.

10. The hinge arrangement as defined in claim 1 including a resilient tongue bordering on at least one side of said opening in said base plate.

11. The hinge arrangement as defined in claim 1 wherein at least one lug is formed on said extended portion said extended portion being aligned parallel with one face of said base plate, said base plate having web means engaging said extended portion, said web means bounding said opening of said base plate, said web means forming a projection supporting said lug.

12. The hinge arrangement as defined in claim 11 wherein said extended portion faces the rear in relation to said toggle joint means.

13. The hinge arrangement as defined in claim 11 wherein said extended portion has a groove, said web means being locked in said groove when in assembled position.

14. The hinge arrangement as defined in claim 11 wherein said base plate has a groove, said extended portion being guided in said groove.

15. The hinge arrangement as defined in claim 11 wherein the intermediate element carrying said extended portion has a projection facing said base plate, said base plate having a guide groove, said projection on said intermediate element facing said base plate extending into said guide groove in said base plate when in assembled position.

16. The hinge arrangement as defined in claim 1 wherein said extended portion is located on one side to said toggle joint means.

* * * * *